US007654234B2

(12) United States Patent
Polt

(10) Patent No.: US 7,654,234 B2
(45) Date of Patent: Feb. 2, 2010

(54) BARREL ENGINE BLOCK ASSEMBLY

(75) Inventor: Anton Polt, Judendorf-Strassengel (AT)

(73) Assignee: Thomas Engine Company, LLC, Boulder, CO (US)

( * ) Notice: Subject to any disclaimer, the term of this patent is extended or adjusted under 35 U.S.C. 154(b) by 275 days.

(21) Appl. No.: 11/672,975

(22) Filed: Feb. 9, 2007

(65) Prior Publication Data

US 2007/0193555 A1 Aug. 23, 2007

Related U.S. Application Data

(60) Provisional application No. 60/774,982, filed on Feb. 17, 2006.

(51) Int. Cl.
*F02B 75/18* (2006.01)
*F01P 1/08* (2006.01)

(52) U.S. Cl. ..... 123/56.1; 123/41.41

(58) Field of Classification Search ..... 123/41.34, 123/41.41, 41.76, 54.1, 54.3, 56.1, 56.2, 123/56.8, 241, 43 AA
See application file for complete search history.

(56) References Cited

U.S. PATENT DOCUMENTS 2,243,817 A * 5/1941 Herrmann ..... 123/41.31
2,243,818 A * 5/1941 Herrmann ..... 123/41.31
2,243,819 A * 5/1941 Herrmann ..... 123/196 R
3,139,038 A * 6/1964 Stewart ..... 91/507
3,207,082 A * 9/1965 Pitt et al. ..... 91/507
3,241,495 A * 3/1966 Diedrich et al. ..... 91/507
3,319,874 A * 5/1967 Welsh ..... 417/271
3,695,240 A 10/1972 Cookson
3,844,258 A * 10/1974 Howell ..... 123/43 AA
4,022,167 A * 5/1977 Kristiansen ..... 123/43 AA
4,492,188 A * 1/1985 Palmer et al. ..... 123/56.8
4,708,105 A 11/1987 Leydorf, Jr. et al.
H777 H 5/1990 Natarajan
5,103,778 A * 4/1992 Usich, Jr. ..... 123/56.8
5,701,670 A * 12/1997 Fisher et al. ..... 29/890.01
6,155,214 A * 12/2000 Manthey ..... 123/43 AA
6,260,520 B1 7/2001 Van Reatherford
6,305,335 B1 * 10/2001 O'Toole ..... 123/56.3
6,688,100 B1 * 2/2004 Wherley et al. ..... 60/257
6,698,394 B2 * 3/2004 Thomas ..... 123/241
6,889,496 B2 5/2005 Beyer et al.
6,938,590 B2 * 9/2005 Buelna ..... 123/56.8
6,986,342 B2 1/2006 Thomas
7,409,932 B2 * 8/2008 Gaiser ..... 123/56.2
7,469,665 B2 * 12/2008 Stephens ..... 123/56.1
2007/0186880 A1 * 8/2007 Gaiser ..... 123/55.5

* cited by examiner

*Primary Examiner*—Hai H Huynh
(74) *Attorney, Agent, or Firm*—Gifford, Krass, Sprinkle, Anderson & Citkowski, P.C.

(57) ABSTRACT

A barrel internal combustion engine includes a drive shaft assembly, a monoblock, a plurality of piston assemblies, and a valvetrain. The driveshaft assembly has a central drive shaft and a cam plate extending therefrom. The one piece monoblock has a longitudinal central axis with a central longitudinal opening receiving the drive shaft, the one piece monoblock further defines a plurality of combustion chambers, a coolant system, a plurality of intake passages and a plurality of exhaust passages. The combustion chambers each have an axis parallel to the central axis and are defined in a circle concentric with the longitudinal axis. Each chamber has a generally cylindrical side wall, a first closed end and a second open end, an intake valve opening and an exhaust valve opening being defined in the first closed end of each combustion chamber. The coolant system includes a plurality of coolant passages.

23 Claims, 16 Drawing Sheets

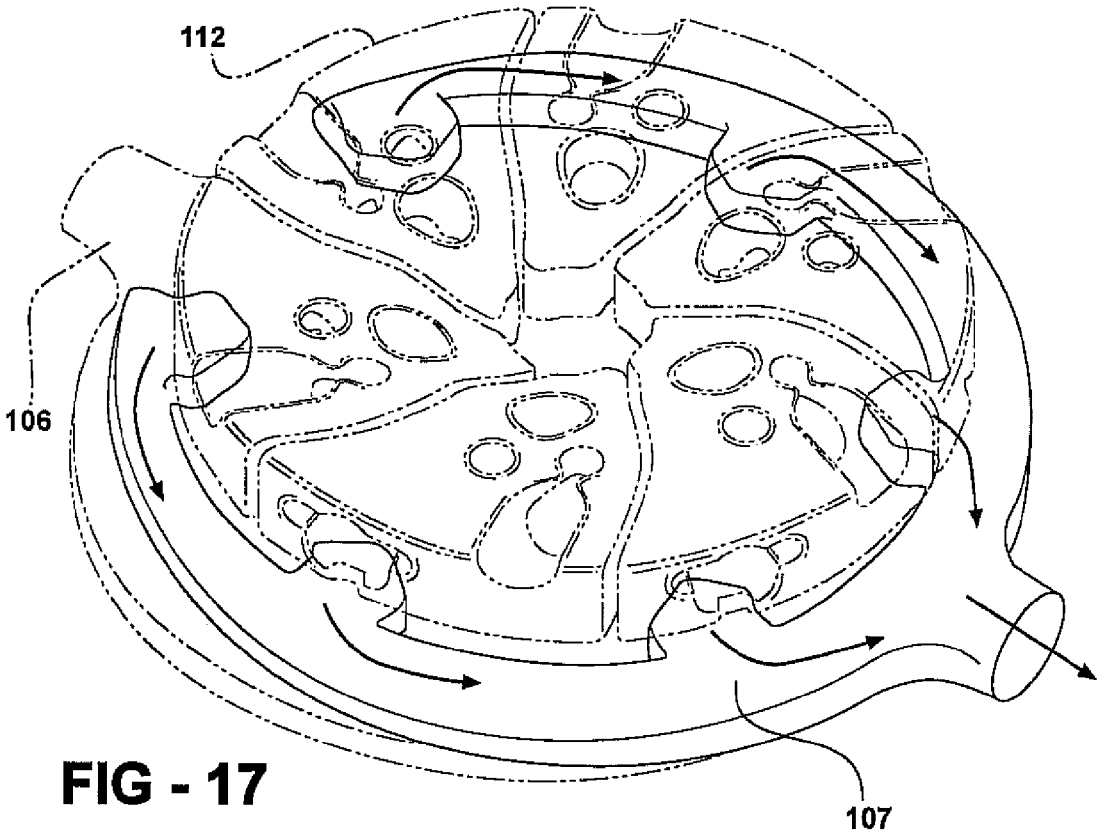
FIG - 17
FIG - 18
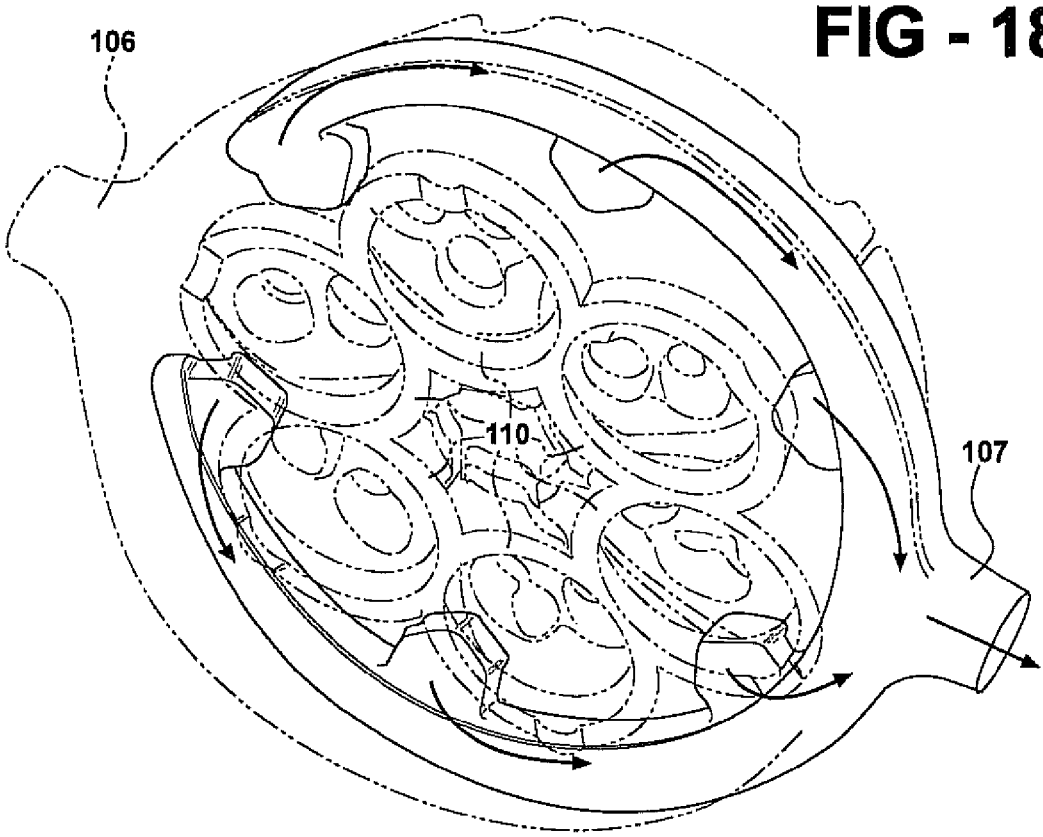

BARREL ENGINE BLOCK ASSEMBLY

REFERENCE TO RELATED APPLICATION

This application claims priority from U.S. Provisional Patent Application Ser. No. 60/774,982, filed Feb. 17, 2006, the entire content of which is incorporated herein by reference.

FIELD OF THE INVENTION

The invention relates to barrel-type internal combustion engines. More particularly, the invention relates to the engine block assembly of the barrel engine.

BACKGROUND OF THE INVENTION

Internal combustion engines are widely used for driving a variety of vehicles. Internal combustion engines come in a variety of configurations, which are typically aptly named for the particular orientation or arrangement of the reciprocating pistons and cylinders in the engines. One example of an internal combustion engine is a "V" type engine, in which the "V" refers to the arrangement of the cylinders in rows that are angled relative to each other to form a V shape. Another type of internal combustion engine that is most relevant to the invention is a barrel-type engine.

The barrel engine includes a plurality of cylinders and pistons arranged in the form of a "barrel" in which their axes are parallel to each other and typically arranged along a circle concentric with the drive shaft. Power is transmitted from the reciprocating pistons to a cam plate via a roller or bearing interface. The cam plate's nominal plane is perpendicular to the piston axes and attached to the drive shaft for movement therewith. The cam plate has a generally sinusoidal shape, so that the axial reciprocal movement of the pistons causes rotational movement of the cam plate and drive shaft.

It remains desirable to provide an improved, modern barrel engine design utilizing a monoblock design having integrated intake/exhaust ports and passages for coolant flow.

SUMMARY OF THE INVENTION

The present invention provides a barrel internal combustion engine in which some embodiments are constructed using a one-piece monoblock. In a first embodiment, the barrel internal combustion engine includes a driveshaft assembly with a central driveshaft and a cam plate extending therefrom. A one-piece monoblock has a longitudinal central axis with a central longitudinal opening receiving the driveshaft. The one piece monoblock further defines a plurality of combustion chambers each having an axis parallel to the central axis. The combustion chambers are defined in a circle concentric with the longitudinal axis. Each combustion chamber has a generally cylindrical sidewall, a first closed end, and a second open end. An intake valve opening and an exhaust valve opening are defined in the first closed end of each combustion chamber. The one piece monoblock further defines a coolant system including a plurality of coolant passages, a plurality of intake passages each in fluid communication with one of the intake valve openings, and a plurality of exhaust passages each in fluid communication with one of the exhaust valve openings. A plurality of piston assemblies each has a piston received in one of the combustion chambers. The piston assemblies are in mechanical communication with the cam plate of the driveshaft assembly. A valve train includes a plurality of intake valves and exhaust valves, with each of the valves being received in one of the valve openings in the combustion chambers.

The monoblock may further define an intake manifold in fluid communication with the plurality of intake passages and the intake manifold may be generally annular and concentric with the axis of the monoblock. The coolant system defined by the monoblock may further include at least one coolant manifold that is generally annular and concentric with the axis of the monoblock and in fluid communication with the coolant passages. The coolant system may include a first and a second coolant manifold with each manifold being generally annular and concentric with the axis of the monoblock and in fluid communication with the coolant passages. These coolant manifolds may each define a C-shaped passage extending between a pair of spaced-apart ends. The passages may taper downwardly between a port and the ends and the port may be mid-way between the ends. In such an arrangement, the ports of the first and second manifolds may be positioned generally on opposite sides of the engine such that the downwardly tapered ends of one manifold are disposed adjacent the port of the other manifold. The barrel internal combustion engine may further include a drive case attached to the monoblock and a second monoblock attached to the drive case. The second monoblock may define a plurality of compression chambers and the piston assemblies may each further include a second piston received in one of the compression chambers. Alternatively, the barrel internal combustion engine may further include a drive case attached to the monoblock and an output housing attached to the drive case.

According to another embodiment of the present invention, a barrel internal combustion engine, with or without a monoblock, may include a driveshaft assembly including a central driveshaft and a cam plate extending therefrom. An engine block for this embodiment has a longitudinal central axis with a central longitudinal opening for receiving the driveshaft. The block has a plurality of combustion chambers each having an axis parallel to the central axis. These combustion chambers are defined in a circle concentric with the longitudinal axis. The block also has a plurality of coolant passages defined therein. A coolant system for the engine includes at least one coolant manifold that is generally annular and concentric with the axis of the block. The coolant manifold is in fluid communication with the coolant passages in the block. A plurality of piston assemblies each has a piston received in one of the combustion chambers and is in mechanical communication with the cam plate of the driveshaft assembly. The block of this embodiment of a barrel internal combustion engine may be a monoblock. The coolant system may include a second cooling manifold that is also generally annular and concentric with the axis of the block, and in fluid communication with the coolant passages. The coolant manifolds may each define a C-shaped passage extending between a pair of ends. The passages may taper downwardly between a port and the ends. In such a configuration, the port may be generally mid-way between the ends with the port of the first manifold and the port of the second manifold being positioned generally on opposite sides of the engine such that the downwardly tapered ends of one manifold are disposed adjacent the port of the other manifold. The engine may further include an intake manifold that is generally annular and concentric with the axis of the block.

According to a further aspect of the present invention, a coolant system is provided for a barrel internal combustion engine of the type having a central longitudinal axis with a plurality of combustion chambers defined in a circle concentric with the axis. The chambers each have an axis parallel to the longitudinal axis. The coolant system includes at least one coolant manifold. The coolant manifold is generally annular and concentric with the axis of the engine. The coolant system may include a second coolant manifold that is also generally annular and concentric with the axis of the engine. Each of the coolant manifolds may define a C-shaped passage extending between a pair of spaced apart ends. The C-shaped passage is made to taper downwardly between a port and the ends. In such a configuration, the port may be mid-way between the ends and the port of the manifolds may be positioned generally on opposite sides of the engine such that the downwardly tapered ends of one manifold are disposed adjacent to the port of the other manifold.

In yet a further aspect of the present invention, a barrel internal combustion engine has a central driveshaft disposed along the longitudinal center axis of the barrel engine and includes a drive case and a monoblock defined in a plurality of combustion chambers. A plurality of bolts fixedly secure the monoblock to the drive case, with the bolts being spaced apart radially outwardly from the center axis and disposed along an outer periphery of the drive case and monoblock.

BRIEF DESCRIPTION OF THE DRAWINGS

Advantages of the present invention will be readily appreciated as the same becomes better understood by reference to the following detailed description when considered in connection with the accompanying drawings, wherein:

FIGS. 11-18 are perspective views of portions of the monoblock illustrating coolant flow through the monoblock;

DETAILED DESCRIPTION OF THE INVENTION

Figure 1:
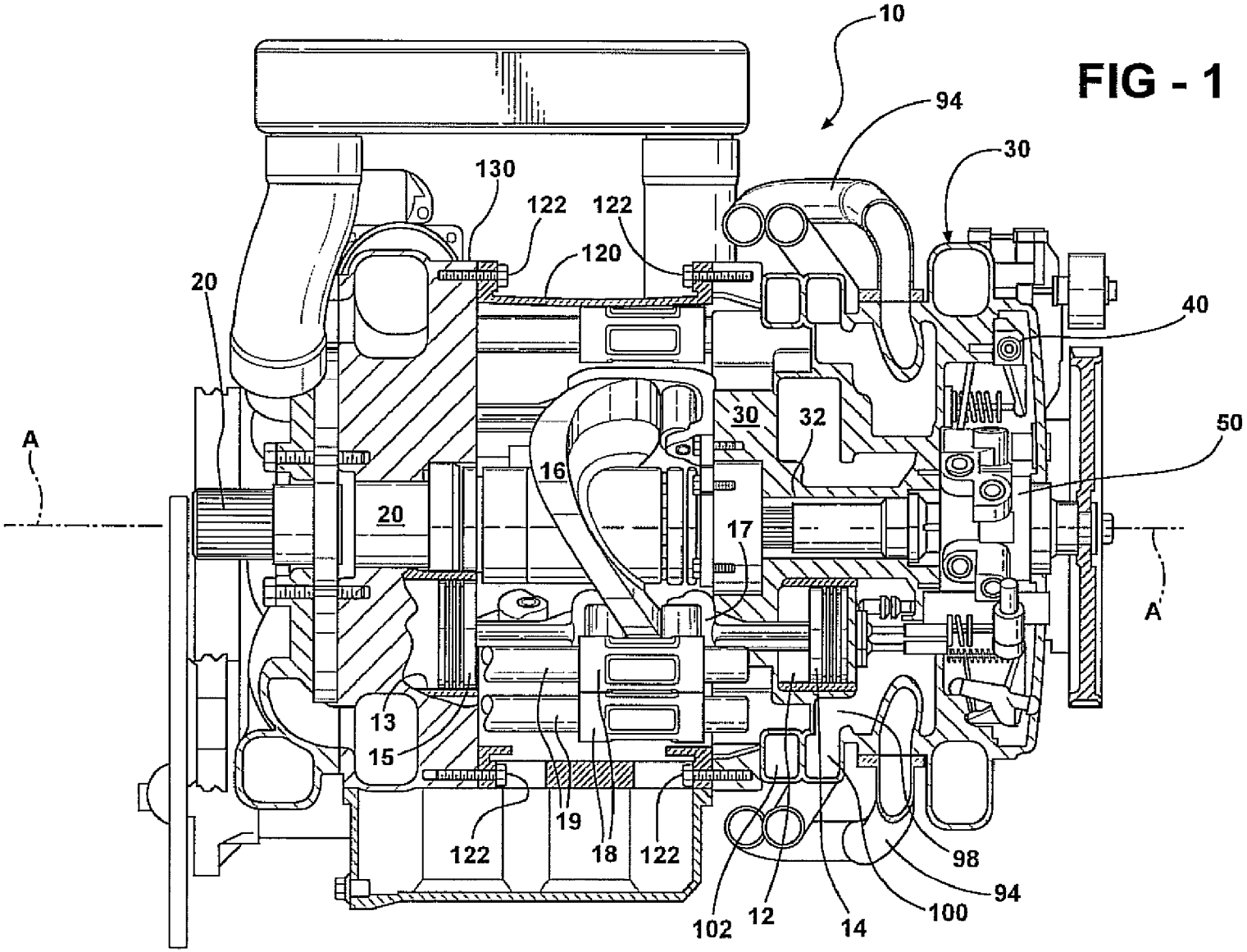
FIG. 1 is a cutaway side view of an internal combustion barrel engine according to one embodiment of the present invention.

Referring to FIG. 1, a barrel-type internal combustion engine according to an embodiment of the present invention is generally indicated at 10. The engine 10 includes a plurality of combustion chambers 12 and pistons 14 arranged generally along a circle that is concentric about a longitudinal central axis A-A defined by a central drive shaft assembly 20. Each combustion chamber 12 has a cylindrical side wall with the pistons 14 slidably received therein for reciprocal axial movement. The axes of the combustion chambers and the piston motion are each generally parallel with the central axis. A combustion cycle occurs in the combustion chambers 12 to cause reciprocal movement of the pistons 14. Power is transmitted from the reciprocating pistons 14 to a cam plate 16 via a roller or bearing interface. The drive shaft assembly 20 includes a central drive shaft coupled to the cam plate 16 for rotation therewith about the longitudinal axis A-A of the shaft assembly 20. The cam plate 16 has a generally sinusoidal shape, such that the reciprocal axial movement of the pistons 14 causes corresponding rotational movement of the cam plate 16 and shaft assembly 20.

The illustrated embodiment of the engine 10 is a double ended design, wherein the first set of pistons 14 and combustion chambers 12 form the combustion end of the engine 10 and a second set of pistons 15 and chambers 13 form a supercharger or compressor end of the engine 10. The first and second set of pistons are coupled together by a connecting rod or member 17 so that they move together along substantially the same axis. In the illustrated embodiment, the connecting rod or member 17 includes a cross head guide feature wherein guide members 18 are attached to the piston assembly and slide along guide rods 19.

The pistons 15 in the second set are slidably engaged with cylindrical side walls of compression chambers 13. The pistons 15 and compression chambers 13 cooperate to function as a compressor or supercharger for compressing intake air used in the combustion cycle in the combustion end of the engine. In an alternative embodiment, the engine is single ended. For this embodiment, each of the piston assemblies includes only a combustion end and the compressor end of the engine is eliminated and/or replaced with a closure panel or assembly. As a further alternative, double ended piston assemblies may be used without a compression function on the second end. Instead, the second end of each piston assembly may serve as a guide or stabilizing member.

Described in greater detail below, the illustrated embodiment of the engine 10 includes three main components that form an engine block assembly: a first monoblock 30 that defines the combustion chambers and cylinder head, a drive case 120, and a second monoblock 130 that defines the compression chambers.

Figure 9:
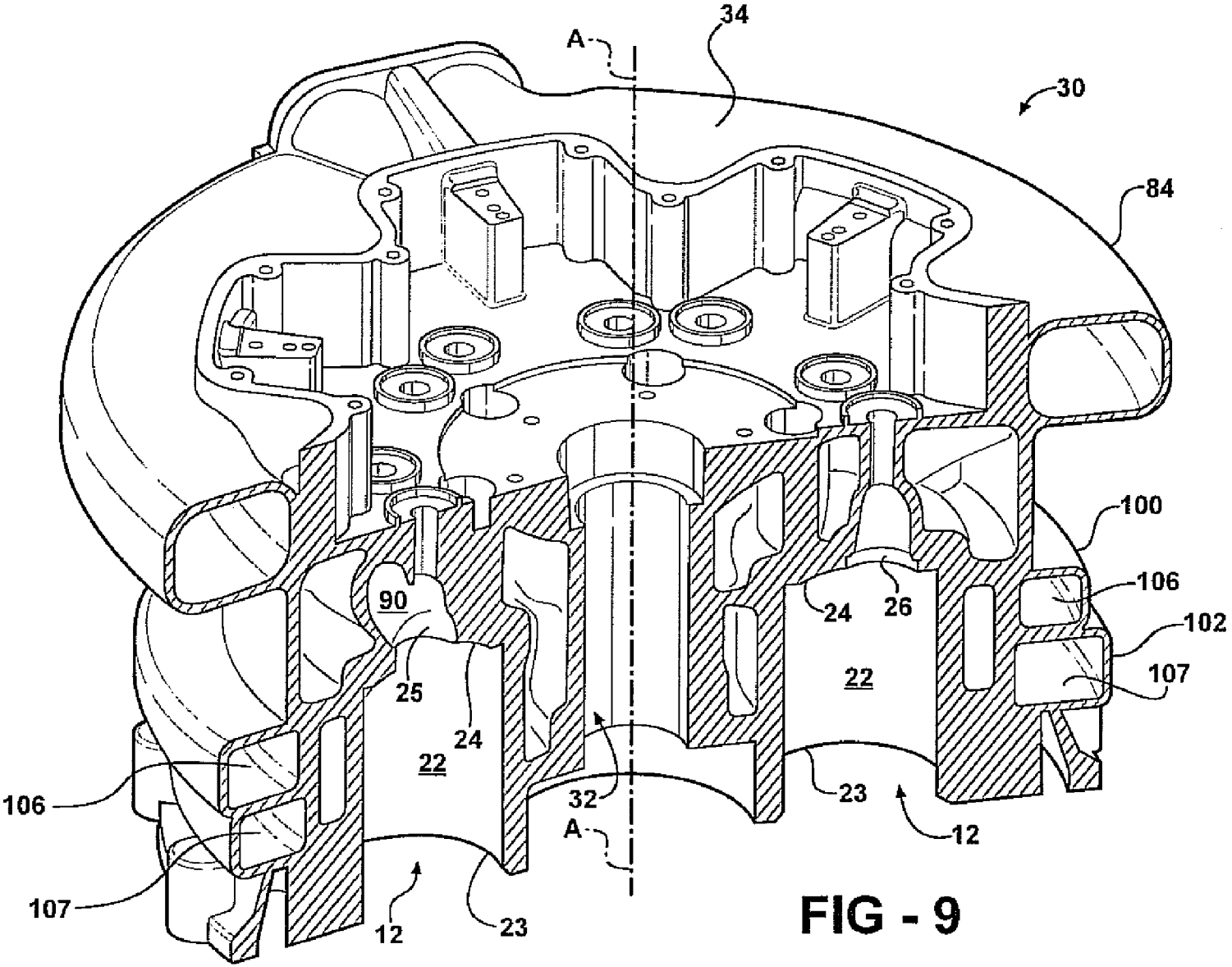
FIG. 9 is a cutaway side perspective view of the monoblock, showing the relative positioning of the coolant manifolds, the intake manifold, the central bore for supporting the drive shaft, and the combustion chambers.
Figure 10:
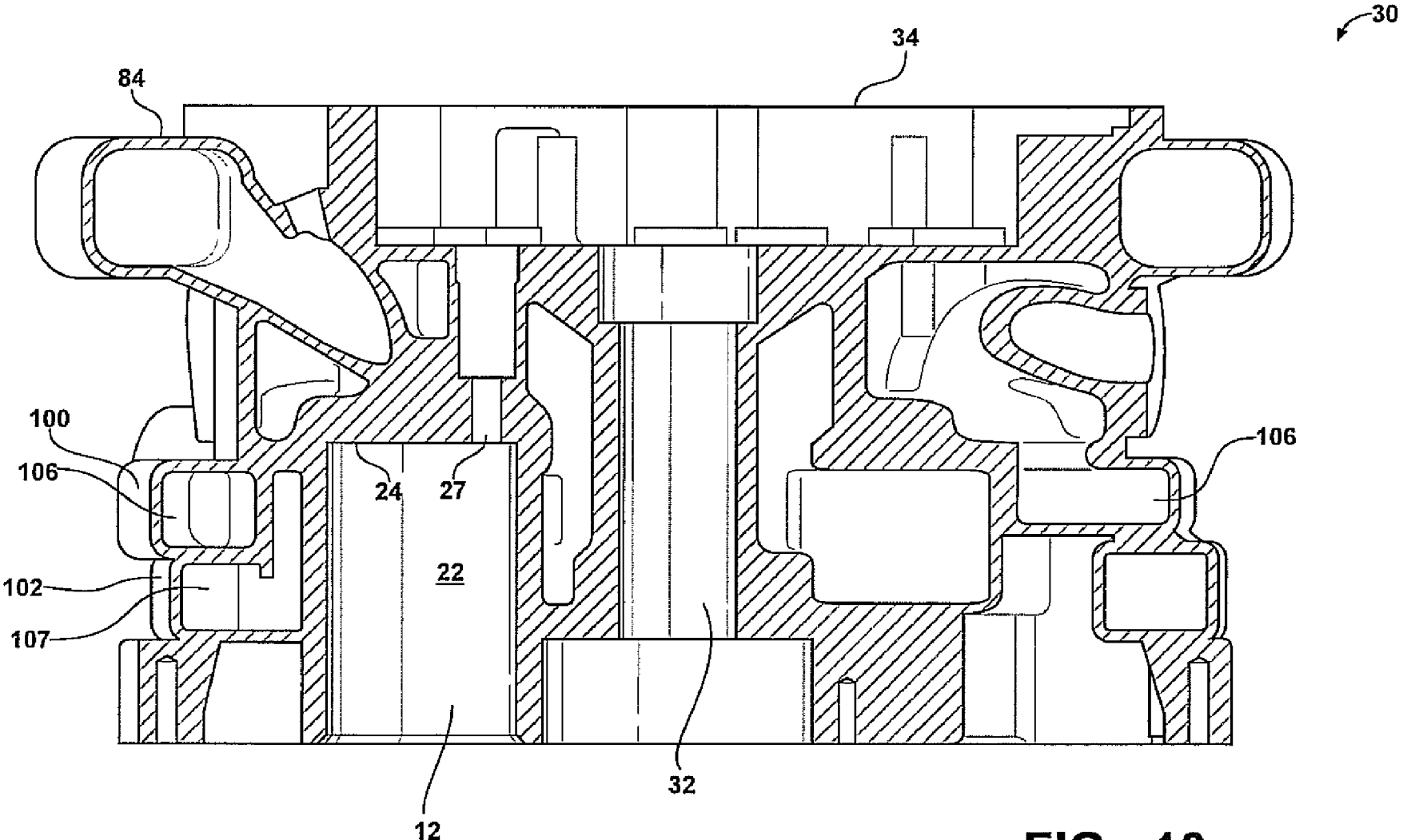
FIG. 10 is a cutaway side view of the monoblock.

The first or combustion monoblock 30 is preferably formed in a molding or casting process, though it should be appreciated that subsequent milling or surface treatment operations may be necessary before the monoblock 30 is ready for use in the barrel engine 10. The monoblock 30 is generally cylindrically shaped as shown in the FIGS. 2-10. Referring to FIGS. 3, 9 and 10, the monoblock 30 includes a central bore 32 that extends along the longitudinal axis A-A of the drive shaft assembly 20. The combustion chambers 12 are formed in the monoblock 30 and have axes that are parallel with the longitudinal axis of the drive shaft assembly 20.

Each combustion chamber 12 includes a cylindrical side wall 22 that extends between an open end 23 and a closed end 24. In the illustration of FIG. 9, the lower ends of the chambers 12 are the open ends 23 and the upper ends are the closed ends, though it will be clear to those of skill in the art that the orientation of the engine is not limited. In a typical, non-monoblock engine, the end of the combustion chamber is closed by a separate cylinder head that is fastened to the cylinder block with a gasket or other seal therebetween.

In the present monoblock design, the "head" is integral with the portion of the block defining the cylinders so as to define the combustion chambers. The closed end 24 is "closed" in that material extends across the end of the chamber 12, though the closed end 24 includes an intake valve opening 25, an exhaust valve opening 26 and a spark plug opening 27. Alternatively, the closed end 24 may include openings for multiple intake and/or exhaust valves, multiple spark plugs or glow plugs, and/or one or more fuel injectors. When the engine is assembled, traditional poppet valves may be disposed so as to selectively open and close the openings 25 and 26. The closed end 24 of the combustion chamber may include a surface that is generally flat or may be domed or have other shapes. Likewise, the piston may have a generally flat upper surface or may be domed or have other shapes. In operation, combustion occurs in the space defined between the piston 12 and the closed upper end 24 of the combustion chamber. The space may also be partially defined by the portion of the cylindrical walls 22 adjacent the closed end 24.

When the engine 10 is assembled, the open ends 23 of the chambers 12 are directed toward the cam plate 16 and the connecting members 17 extend out of the open ends to engage the cam plate.

In one preferred embodiment of the present invention, the monoblock 30 is cast in aluminum with iron cylinder liners having a thickness of 1.5-3.0 mm defining the cylindrical walls 22 of the combustion chambers 12. Alternatively, the monoblock maybe formed in other ways and/or out of other materials.

Figure 2:
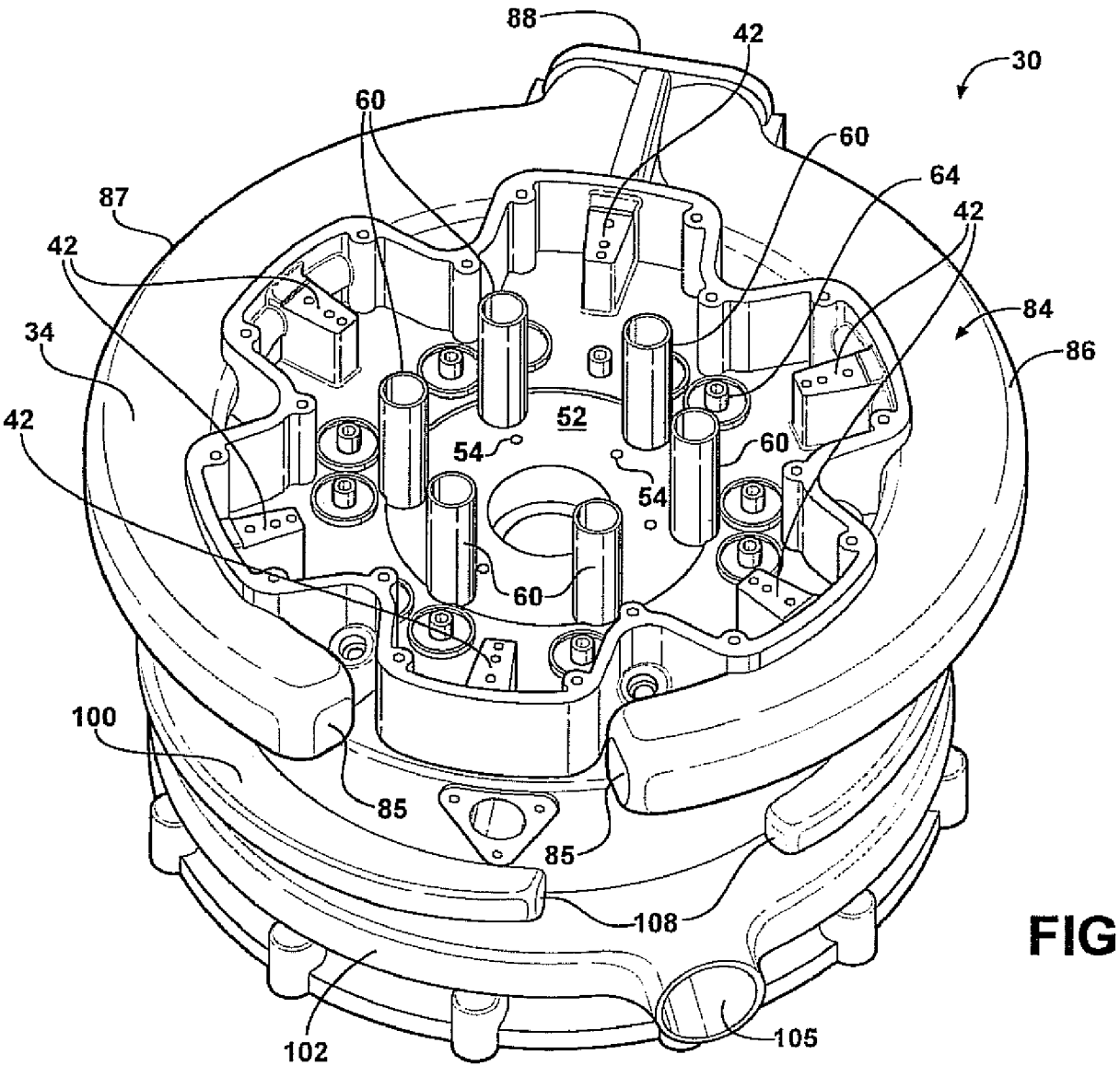
FIG. 2 is a top perspective view of a monoblock that forms part of the engine of FIG. 1.
Figure 3:
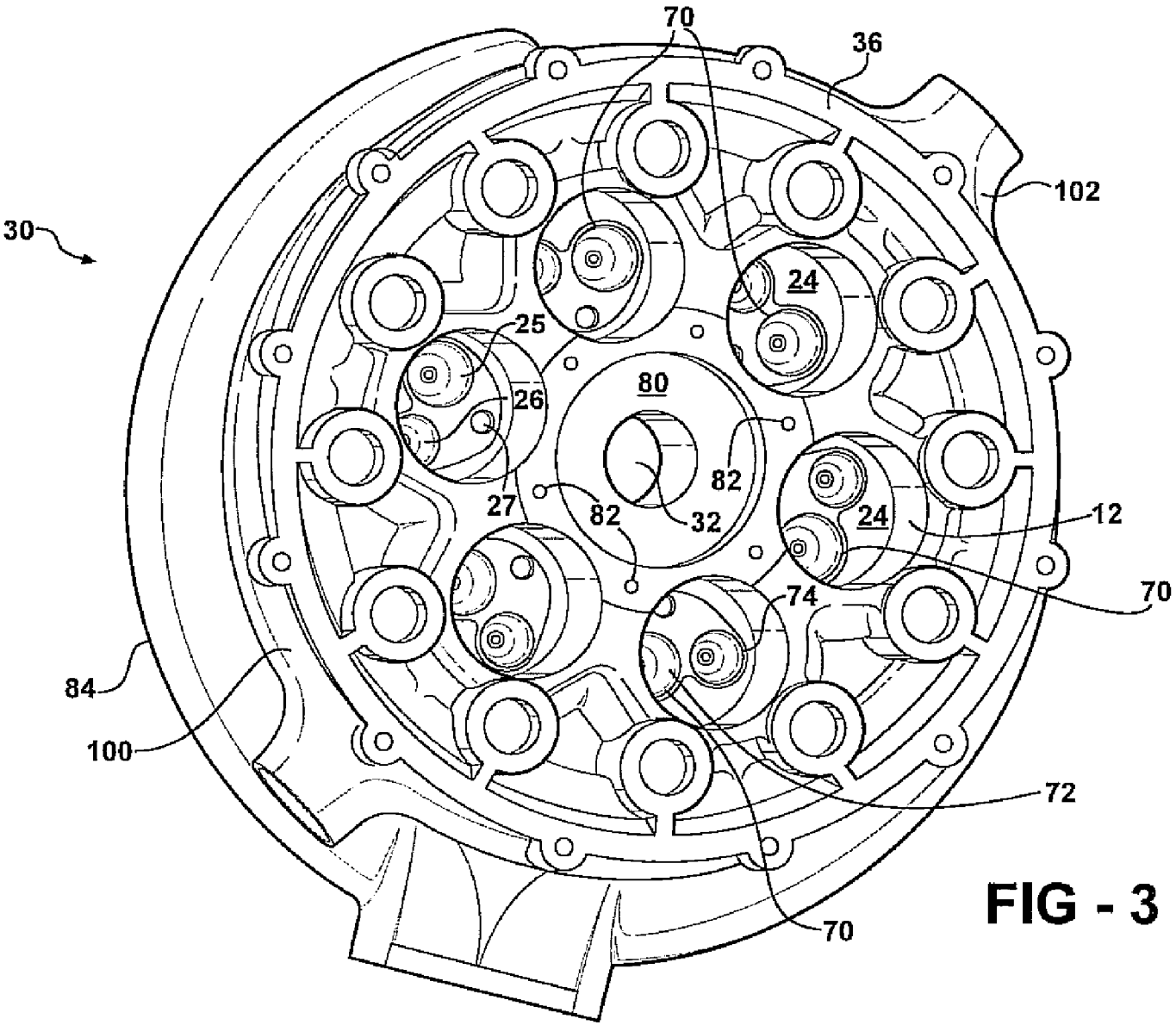
FIG. 3 is a bottom perspective view of the monoblock.
Figure 4:
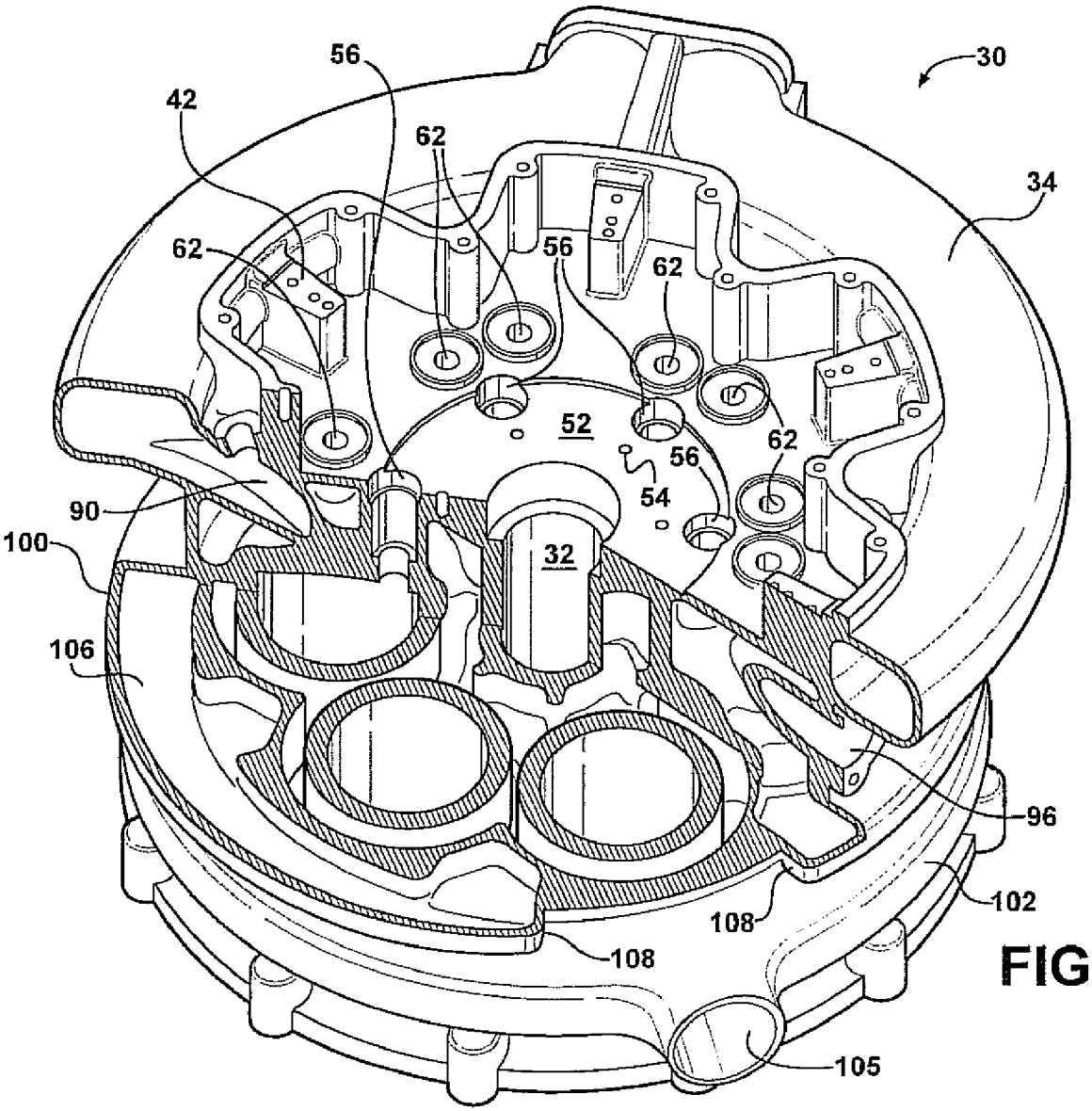
FIG. 4 is a cutaway top perspective view of the monoblock, showing a portion of the intake system and the communication between the first coolant manifold and some of the coolant passages.
Figure 5:
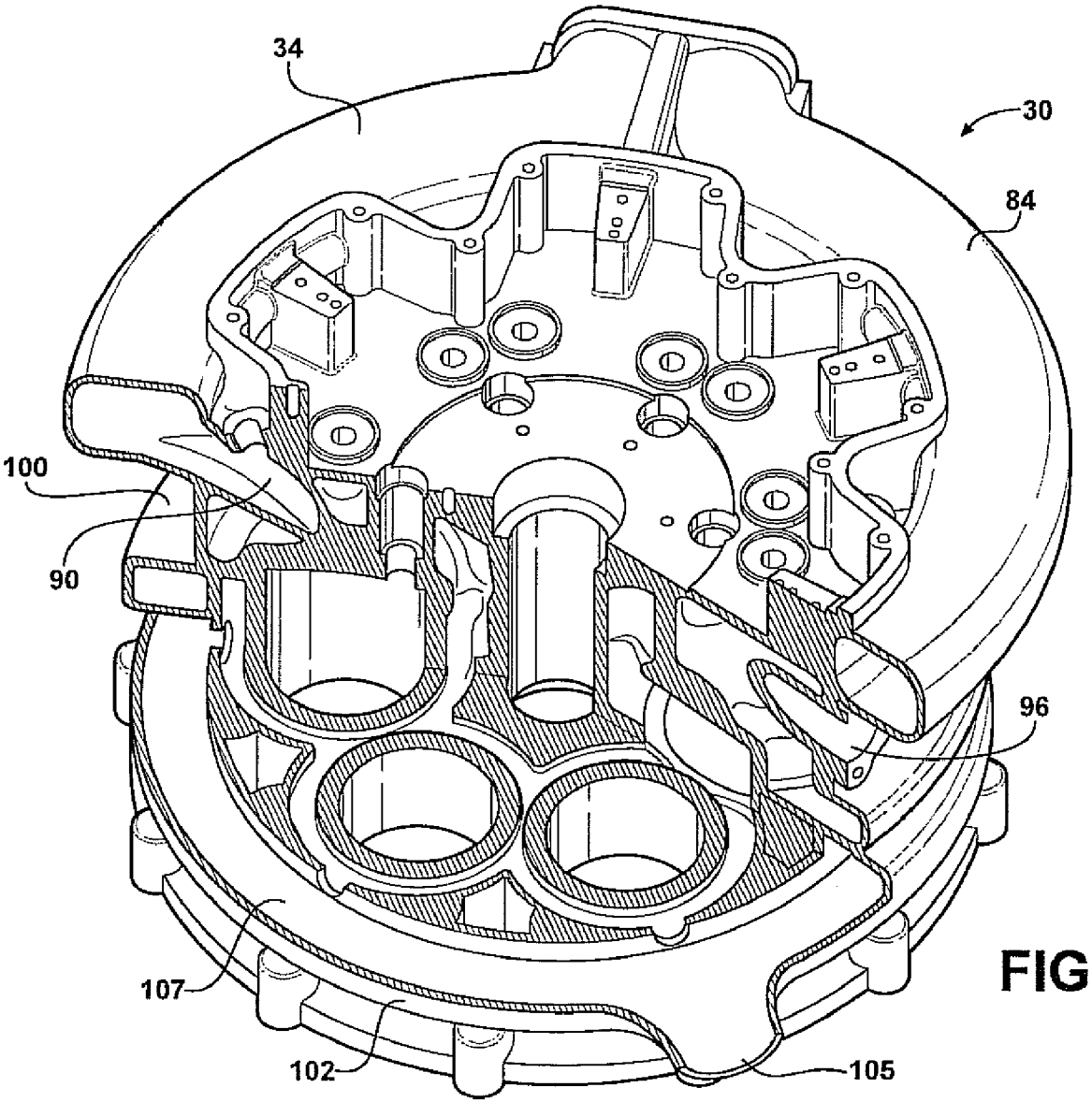
FIG. 5 is a top perspective view of the monoblock, which is further cutaway to show the communication between the coolant passages and the second coolant manifold.

The monoblock 30 extends axially between a top end 34 which is shown in FIG. 2 and a bottom end 36 which is shown in FIG. 3. The top end 34 of the monoblock 30 is adapted for supporting a valvetrain for the engine 10. In the illustrated embodiment, the valvetrain includes a rocker assembly 40 and a tappet carrier assembly 50 (FIG. 1). More specifically, rocker shaft flanges 42 for each chamber 12 are formed integrally with the top end 34 of the monoblock 30. Illustratively, a rocker shaft flange 42 is provided for each of the six chambers 12 as shown in FIG. 2. A tappet carrier flange 52 is integrally formed at the top end 34 of monoblock 30. The tappet carrier flange 52 includes a plurality of threaded bores 54 allowing assembly of a tappet carrier assembly 50 thereto by a plurality of bolts. The tappet carrier flange 52 also includes a plurality of bores 56 (FIG. 4) for supporting a plurality of spark plug tubes 60 (FIG. 2). In the illustrated embodiment, the spark plug tubes 60 are not formed integrally with the monoblock 30.

A plurality of guide bores 62 (FIG. 4) are formed in the monoblock 30 for receiving valve guides 64 (FIG. 2) therein. The valves guides 64 preferably are pressed into the guide bores 62. As best shown in FIG. 3, recesses 70 are also provided at the top of each chamber 12 for receiving valve seat inserts 72, 74 which are preferably pressed therein. The bottom end 36 of the monoblock 30 also includes an oil pump flange 80. A plurality of bores 82 are formed in the oil pump flange 80 for threadingly receiving bolts to secure the oil pump flange thereto.

In the illustrated embodiment, the monoblock also defines some or all of the intake manifold and passages for the engine 10. Referring to FIG. 2, the intake system includes an intake manifold 84 defined on the top end 34 of the monoblock. In the illustrated embodiment, the intake manifold 84 is generally annular and concentric with the central axis of the engine. In this embodiment, the manifold 84 does not form a complete ring but instead is C-shaped with a pair of ends 85 that are spaced apart. The C-shaped manifold includes a pair of arcuate halves 86 and 87 that each extend between an inlet 88 and the respective end 85. The halves 86 and 87 may each taper down from the inlet 88 to the end 85. Each half 86 and 87 provides intake air to half of the combustion chambers. In an alternative embodiment, the intake manifold forms a complete ring such that the ends 85 are joined and flow can extend around the entire ring. This embodiment may provide some advantages. This embodiment may taper or may have a generally constant cross section. In a further alternative, the manifold 84 may not be integral with the monoblock or a portion of the manifold, such as the topmost surface, may be formed as a separate piece.

Referring to FIGS. 4-6 and 9, a plurality of intake passages 90 provide fluid communication between the intake manifold 84 and the intake openings 25 in the closed end 24 of the combustion chambers 12. Each of the intake passages 90 extends generally inwardly and downwardly from the intake manifold 84 to the combustion chambers. The passages may have shapes and positions different than illustrated. Preferably, fuel injector ports 89 are provided in each of the intake passages 90 for allowing fuel to be introduced.

Figure 6:
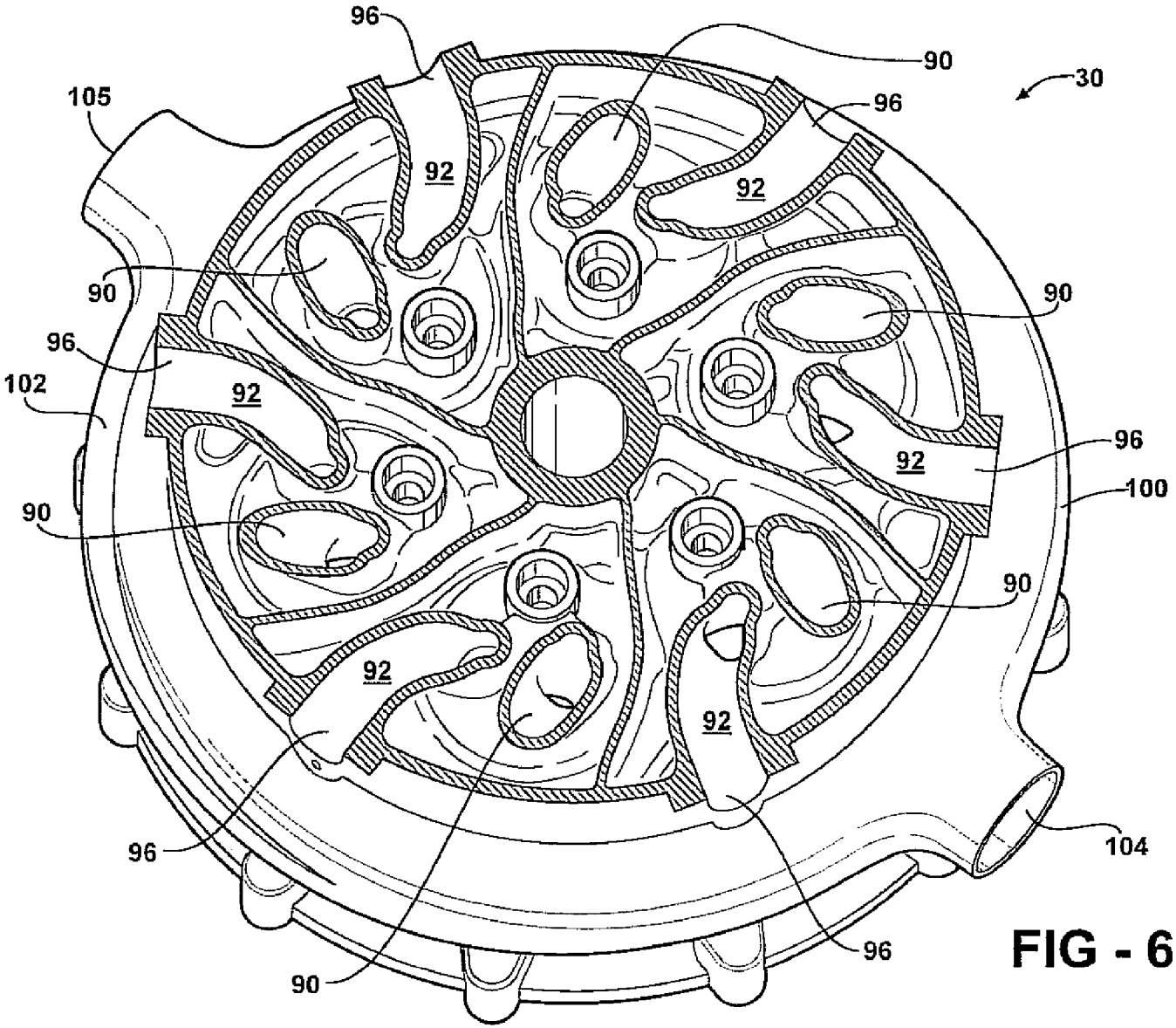
FIG. 6 is a cutaway top perspective view of the monoblock showing a portion of the intake and exhaust passages.

Referring to FIGS. 6 and 9, a plurality of exhaust passages 92 are preferably also integrally formed in the monoblock. Each exhaust passage 92 provides fluid communication between one of the exhaust openings 26 in the combustion chambers 12 and an exhaust port or manifold. In the illustrated embodiment, an exhaust manifold 94 (FIG. 1) is not integral with monoblock 30 but instead connects to a plurality of exhaust ports 96 on the perimeter of the monoblock. The exhaust passages and ports may have shapes and positions different than illustrated.

Figure 7:
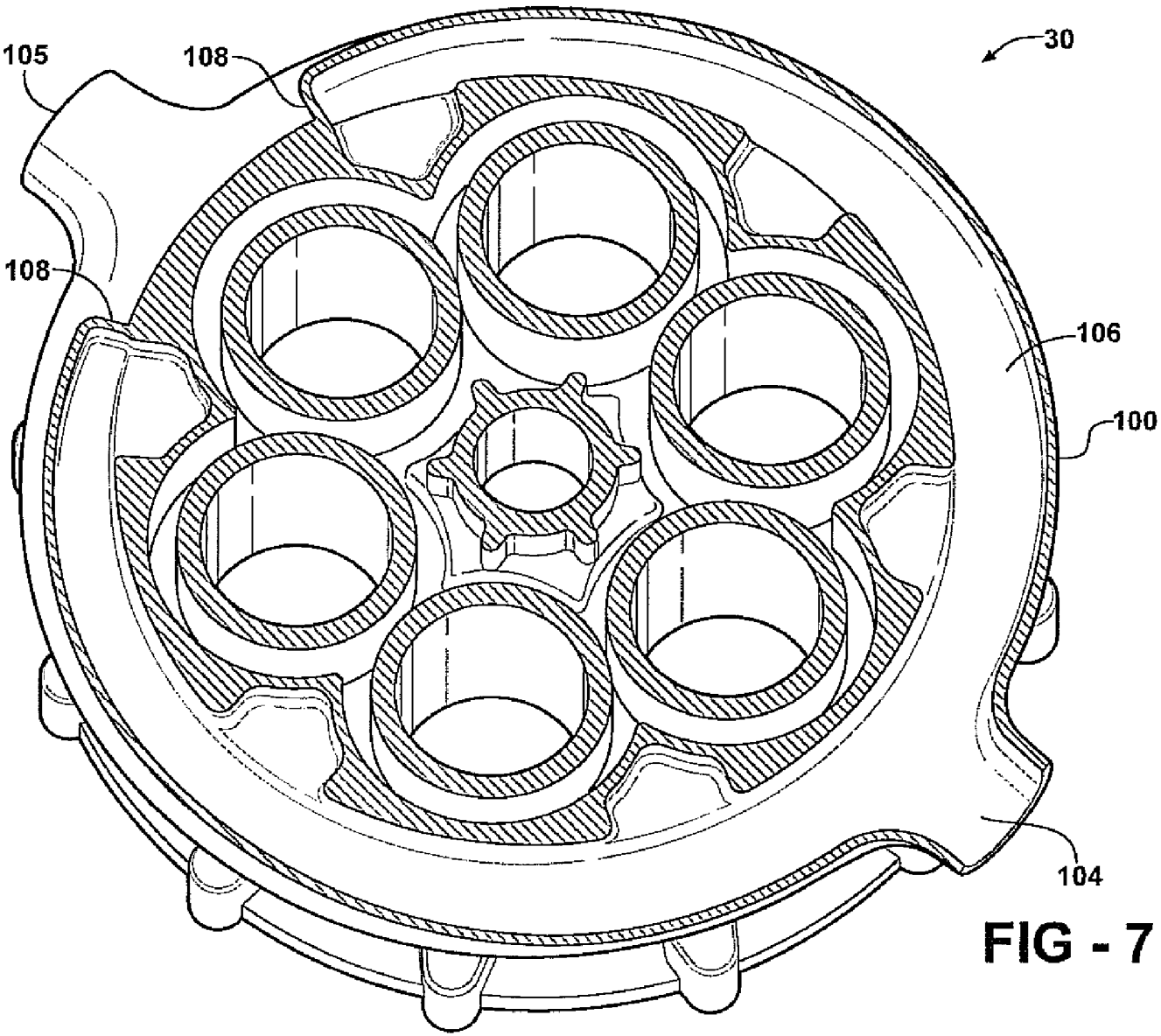
FIG. 7 is a top perspective view of the monoblock, which is further cutaway to show the first coolant manifold.
Figure 8:
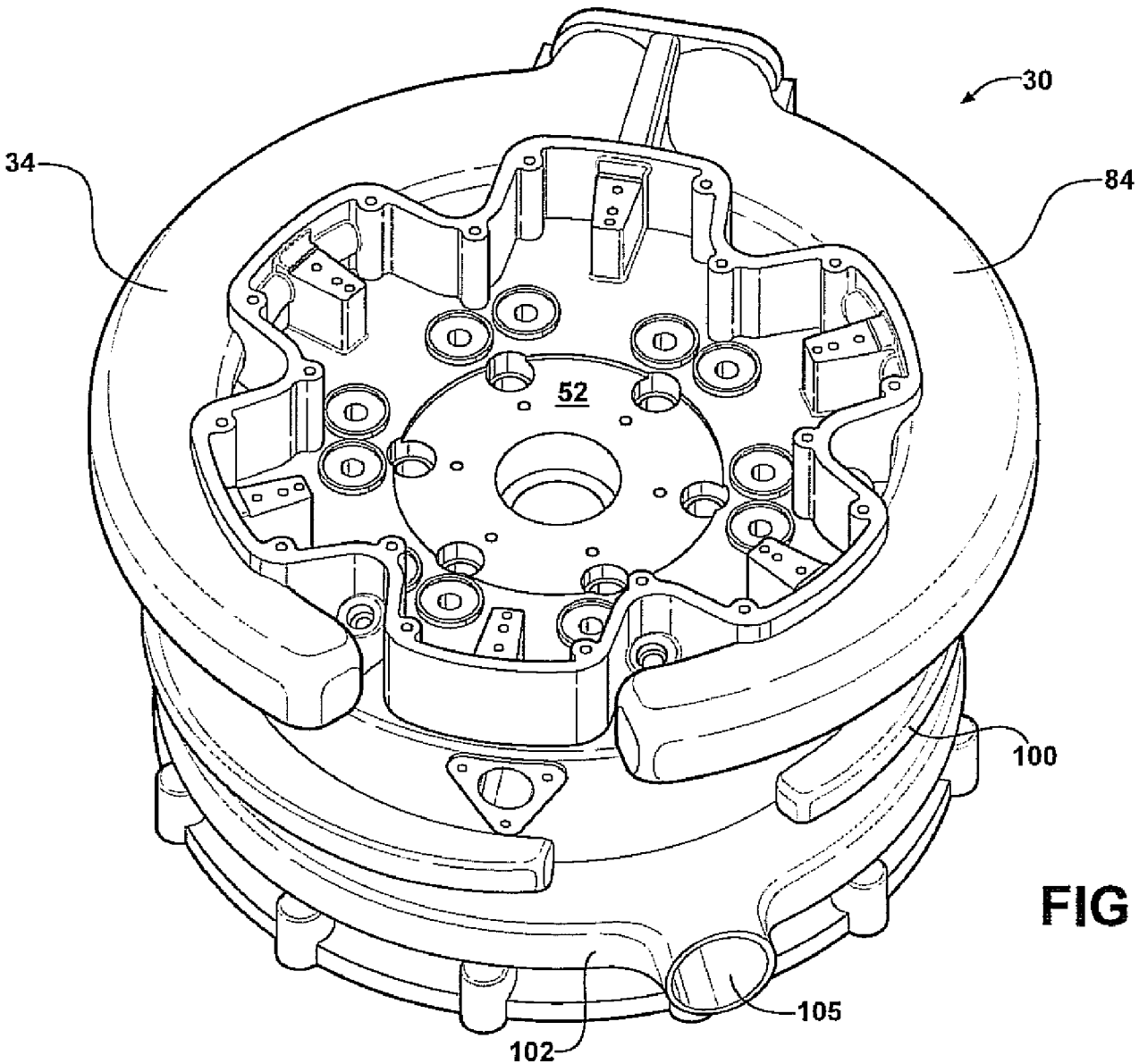
FIG. 8 is a side perspective view of the monoblock.

The monoblock 30 preferably also includes and defines a coolant system for liquid cooling the engine 10. In the illustrated embodiment, the coolant system includes a first coolant manifold, a plurality of coolant passages, and a second coolant manifold. Coolant is introduced into one of the manifolds, flows through the passages, and flows out through the other manifold. Referring to FIGS. 2-10, the first or upper coolant manifold is shown at 100 and the second or lower coolant manifold is shown at 102. Each coolant manifold is generally annular and concentric with the axis of the engine. The coolant manifolds are not complete rings, but instead are generally C-shaped with ends that are spaced apart. Referring to FIG. 7, the monoblock 30 is shown cut away in the plane of the first coolant manifold 100. As shown, the manifold has an inlet or outlet port 104 that communicates with a C-shaped passage 106 that extends between a pair of spaced apart ends 108. The port 104 is approximately half way between the ends. As shown, the C-shaped passage tapers down between the port 104 and each of the ends 108.

The second coolant manifold 102 is similar to the first manifold 100, except that it is rotated approximately 180 degrees about the axis of the engine. The second manifold has an inlet or outlet port 105 that communicates with a C-shaped passage 107. The passage 107 extends between a pair of spaced apart ends with the port 105 being about half way between the ends. The passage 107 tapers down between the port 105 and each of the ends. Alternatively, one or both of the manifolds may form a complete ring and/or may not taper.

The monoblock further defines coolant passages which extend between the manifold and generally surround the cylindrical walls and closed end of the combustion chambers. As will be clear to those of skill in the art, a coolant pump is preferably provided for pumping the coolant through the coolant passages.

Figure 11:
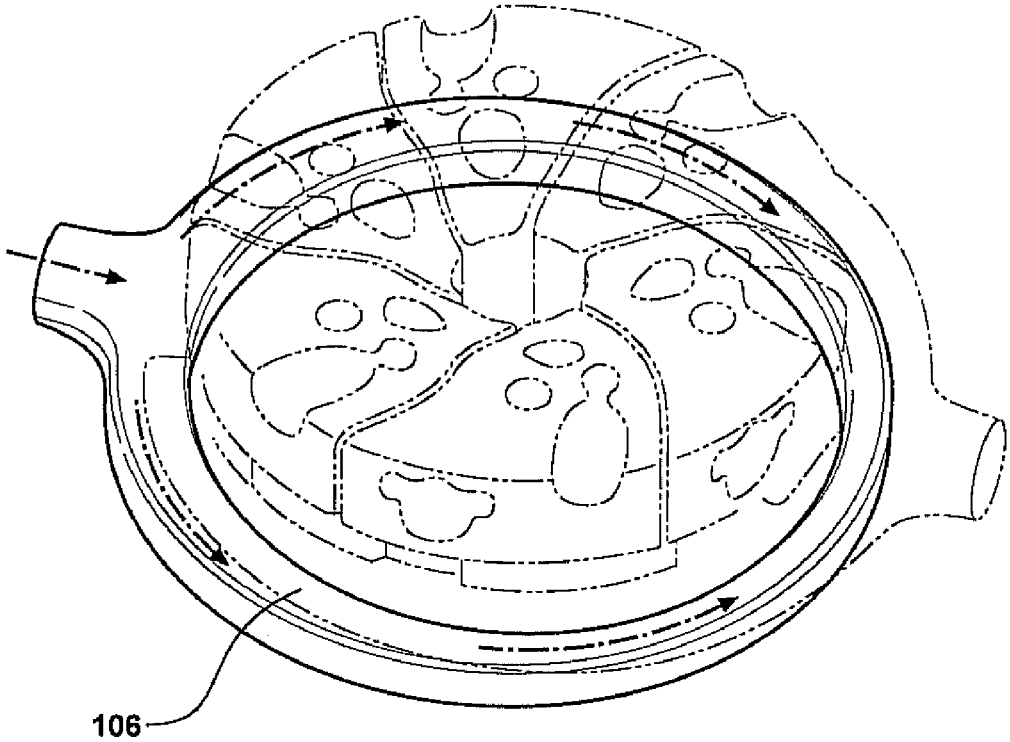
Figure 12:
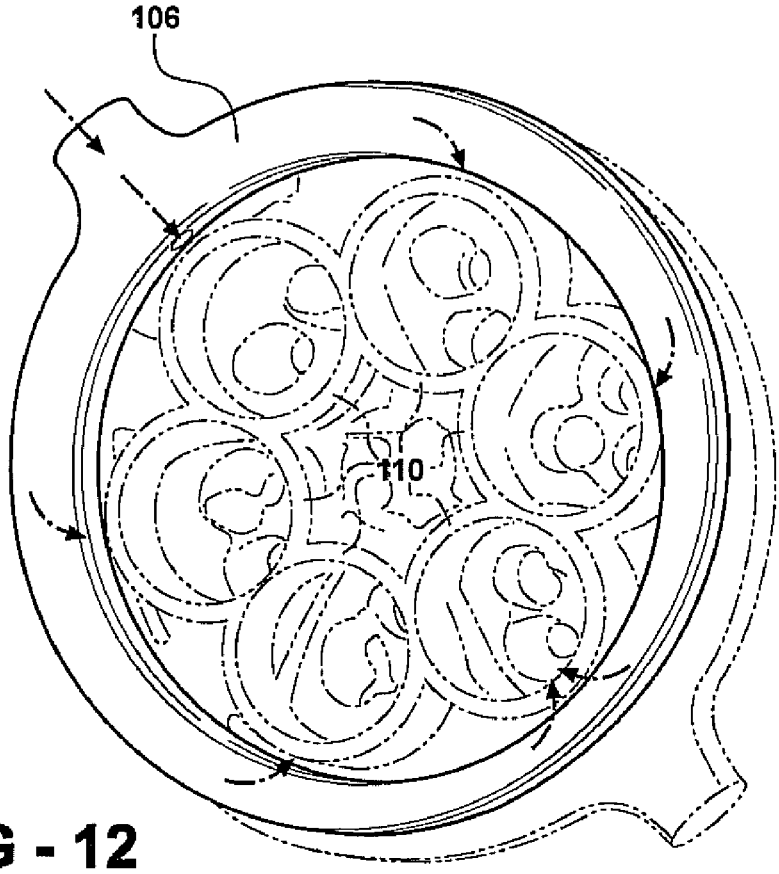
Figure 13:
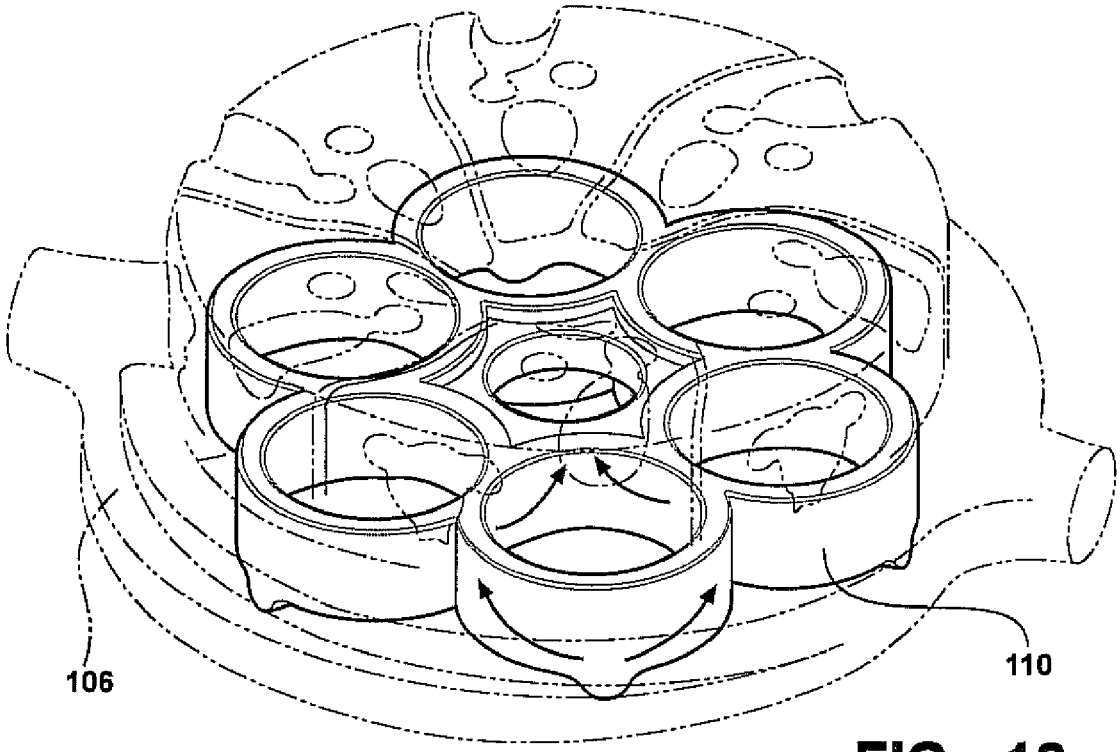
Figure 14:
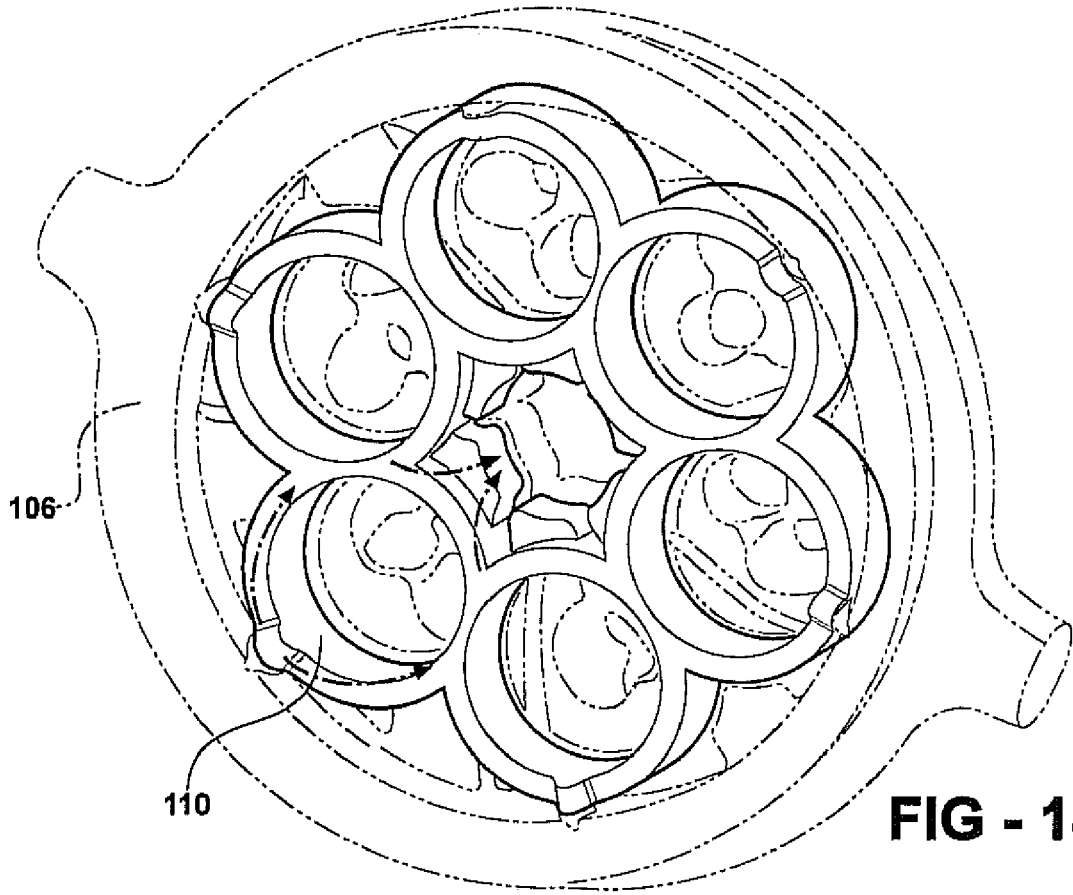
Figure 15:
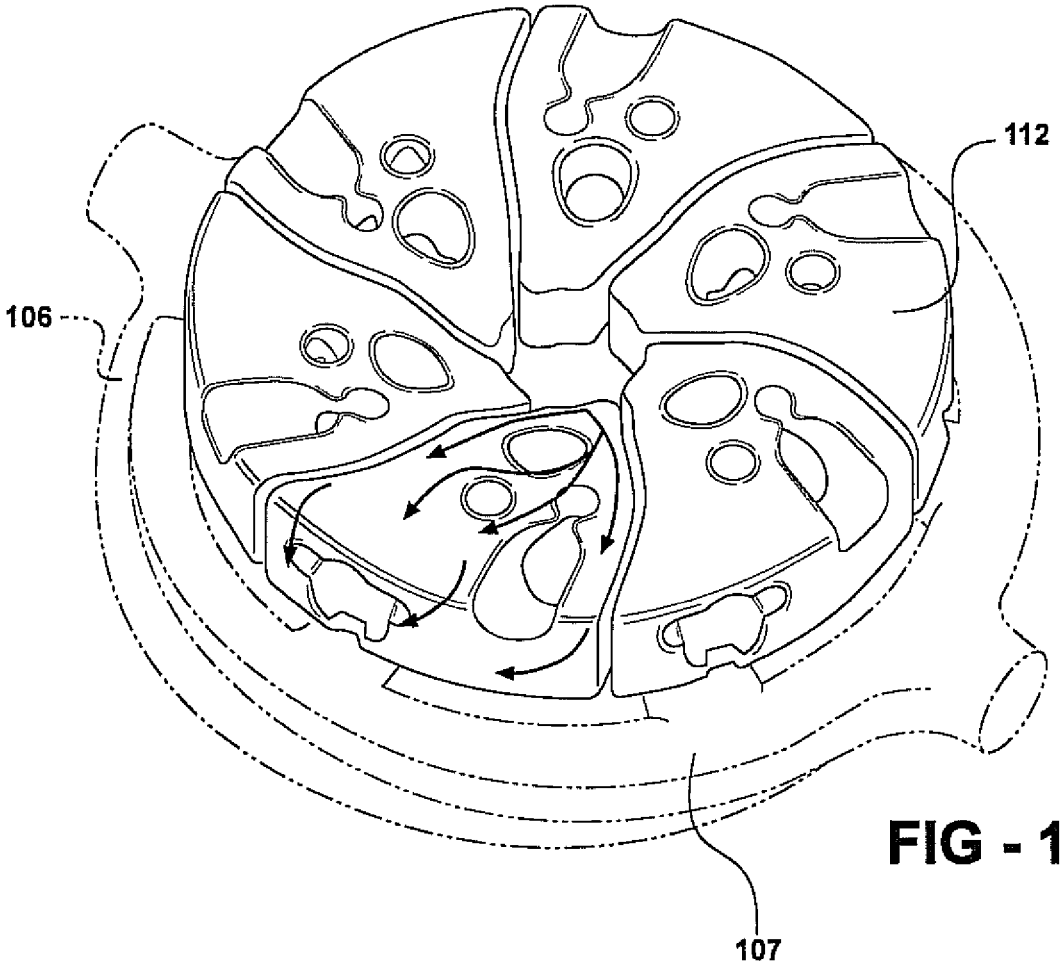
Figure 16:
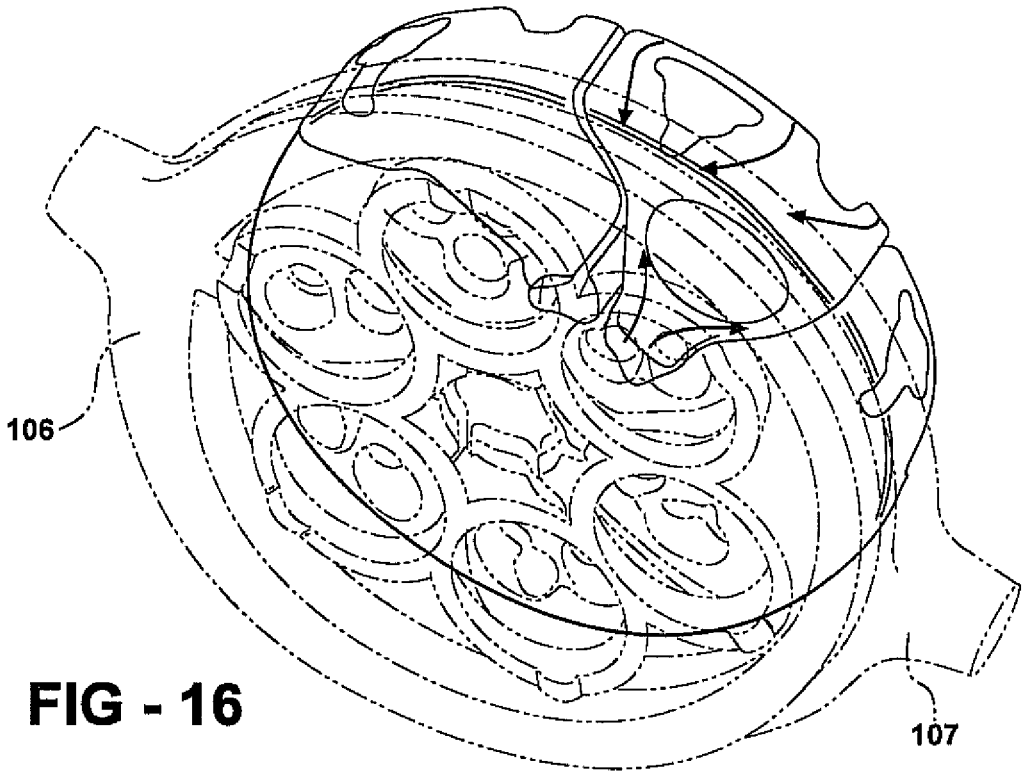

The flow of coolant through the monoblock 30 is best shown in FIGS. 11-18, which illustrate the "negative space" defined by the walls of the monoblock 30. The arrows indicate the direction of flow. Coolant from a radiator (not shown) enters passage 106 in the first coolant manifold (FIG. 11). Coolant moves generally radially inwardly from the first coolant manifold into cylindrically shaped cavities 110 that generally surround the combustion chambers (FIG. 12). A cavity 110 is provided for each chamber in the monoblock 30. Each cavity 110 is in fluid communication with adjacent cavities 110. Coolant flows inwardly through the cavities 110 (FIGS. 13 and 14) and then upwardly through toward spaces 112 defined around the intake and exhaust passages 90 and 92 of the monoblock 30. The coolant moves generally radially outwardly through the spaces 112 between the intake and exhaust passages (FIGS. 15-16). The coolant moves from the spaces 112 into the passage 107 in the second coolant manifold 102 (FIGS. 17-18). The coolant is directed from the second coolant manifold 102 back to a radiator, where the coolant is cooled and redirected back into the first coolant manifold to re-circulate through the monoblock 30 as described immediately above.

While the various aspects of the present invention have been described with respect to a barrel engine using a monoblock to define the combustion chambers, coolant passages and other portions, those of skill in the art recognize that certain aspects of the present invention may be utilized with traditional non-monoblock engine designs. As one example, a coolant system according to the present invention may be used with a barrel engine that is constructed with or without a monoblock. Such a coolant system would use the illustrated approach of having one or more generally annular coolant manifolds that are concentric with a longitudinal axis of the barrel engine. A preferred embodiment would provide a pair of generally annular coolant manifolds that are each generally concentric with the longitudinal axis of the engine. Most preferred is where the coolant passages are each C-shaped and are opposed such that the inlet port of one manifold is opposed to the outlet port of the other manifold. It is also preferred that the manifolds taper downwardly in cross-sectional area from the port to the ends and that the tapers on one manifold be in a direction opposite of the other manifold. In other words, the narrow ends of one manifold are disposed adjacent the wider passages of the other manifold adjacent its port, and vice versa. Such an approach may also be used with a monoblock design with the coolant passages not being an integral part of the monoblock. Instead, the coolant manifolds may be provided as one or more additional components that are attached to the remainder of the engine in any of a variety of known ways.

Figure 19:
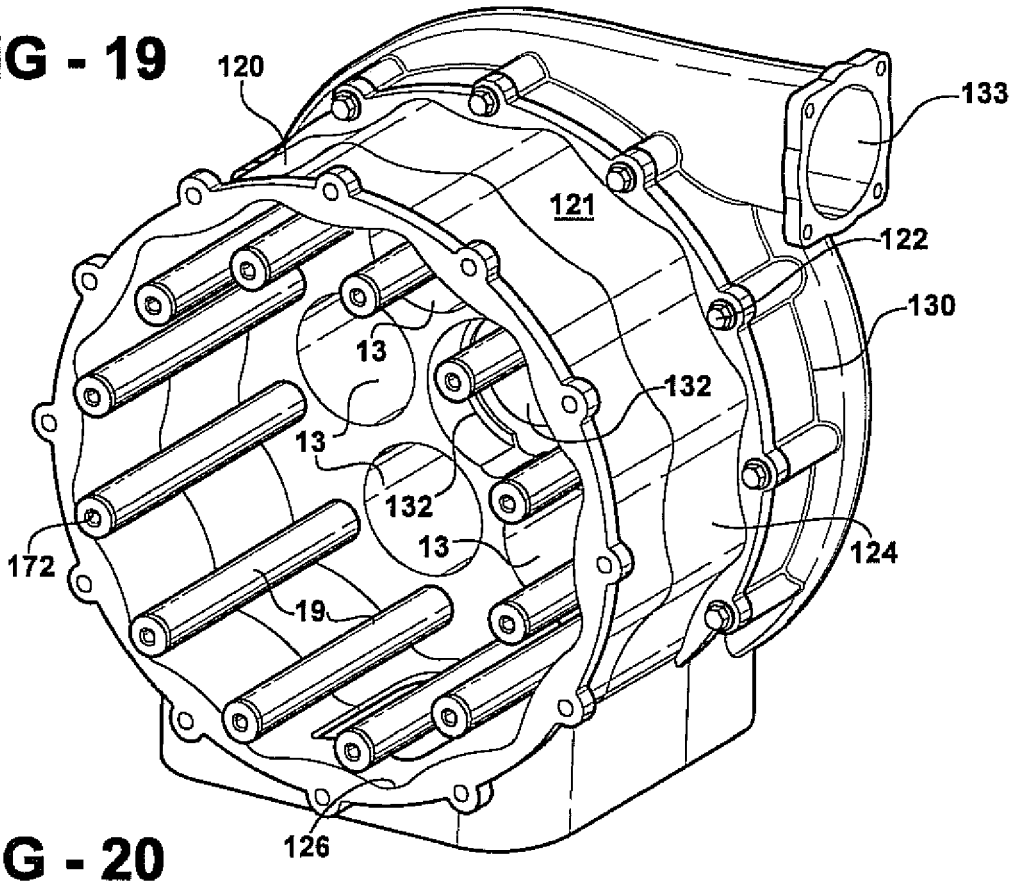
FIG. 19 is a perspective view of a drive case and a compressor cylinder block that form part of the engine of FIG. 1.

As mentioned previously, the embodiment of the present invention illustrated in FIG. 1 includes a second end serving as a compressor or supercharger and a drive case 120 interconnecting the two halves. FIG. 19 illustrates the drive case 120 and the second monoblock 130 that defines the compression chambers. As with the first monoblock, the second monoblock 130 may be formed in a molding or casting process, though it should be appreciated that subsequent milling or surface treatment operations may be necessary before the monoblock 130 is ready for use. The monoblock 130 includes a central bore 132 for receiving the drive shaft assembly 20 therethrough. The compression chambers 13 are formed in the monoblock 130. An annular shaped intake plenum 133 is integrally formed with the monoblock 130.

Figure 20:
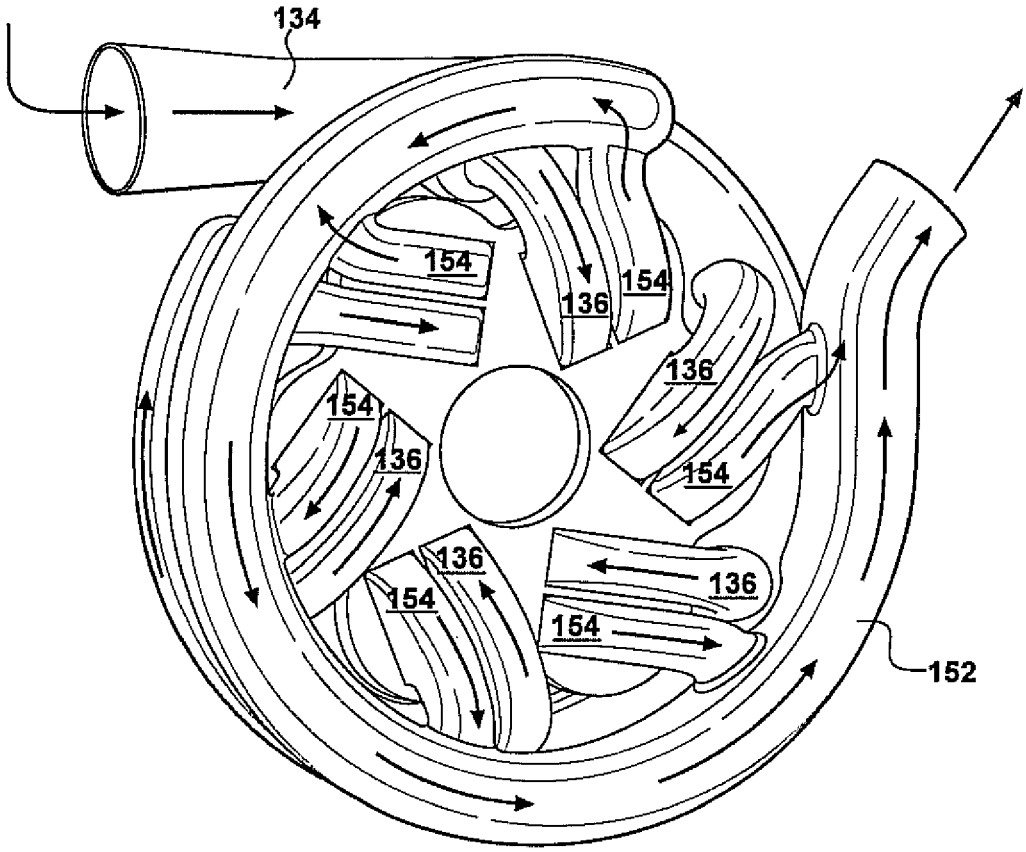
FIG. 20 is a perspective view of a portion of the compressor cylinder block illustrating air flow through intake and exhaust plenums on the compressor side of the barrel engine.

The negative space for the intake 133 and exhaust 150 of the second monoblock 130 is illustrated in FIG. 20. The intake plenum 133 directs air from an annular main intake area 134 into the compression chambers 13 through a plurality of inwardly extending intake channels 136. Compressed air exits the compression chambers 13 through a plurality of inwardly extending exhaust channels 154. Air moves from the exhaust channels 154 into an annular main exhaust area 152. Air is directed from the main exhaust area 156 to an intercooler prior to use in the combustion cycle on the combustion end of the engine. A valve plate ensures one way flow of air through the intake 136 and exhaust 154 channels.

The drive case 120 is disposed between the first monoblock 30 and second monoblock 130. The drive case 120 is coupled to the monoblocks 30 and 130 using bolts 122 (FIG. 1). The drive case 120 has a generally cylindrically shaped wall 121 having opposite outer and inner surfaces. The outer surface of the drive case 120 includes longitudinally extending outer recesses or scallops 124 that facilitate access to the bolts 122 with a wrench. The inner surface of the drive case 120 includes longitudinally extending inner recesses or scallops 126 that are circumferentially offset relative to the outer scallops 124. The inner scallops 126 provide clearance for the guide rods 19. The outer scallops 124 and the outer peripheral locations of the bolts 122 facilitate a compact overall engine size, accommodate more or larger coolant flow passages through the engine, and allow the use of fewer bolts or a smaller bolt specification due to the mechanical advantage provided by the outer peripheral location.

The guide rods 19 slidably support the connecting rods or members 17. Each guide rod 19 preferably has a longitudinally extending bore 172. The ends of the bore 172 may be threaded to couple the guide rod 170 to the monoblocks 30 and/or 130 using bolts. Alternatively, they may be fastened in other ways.

Figure 21:
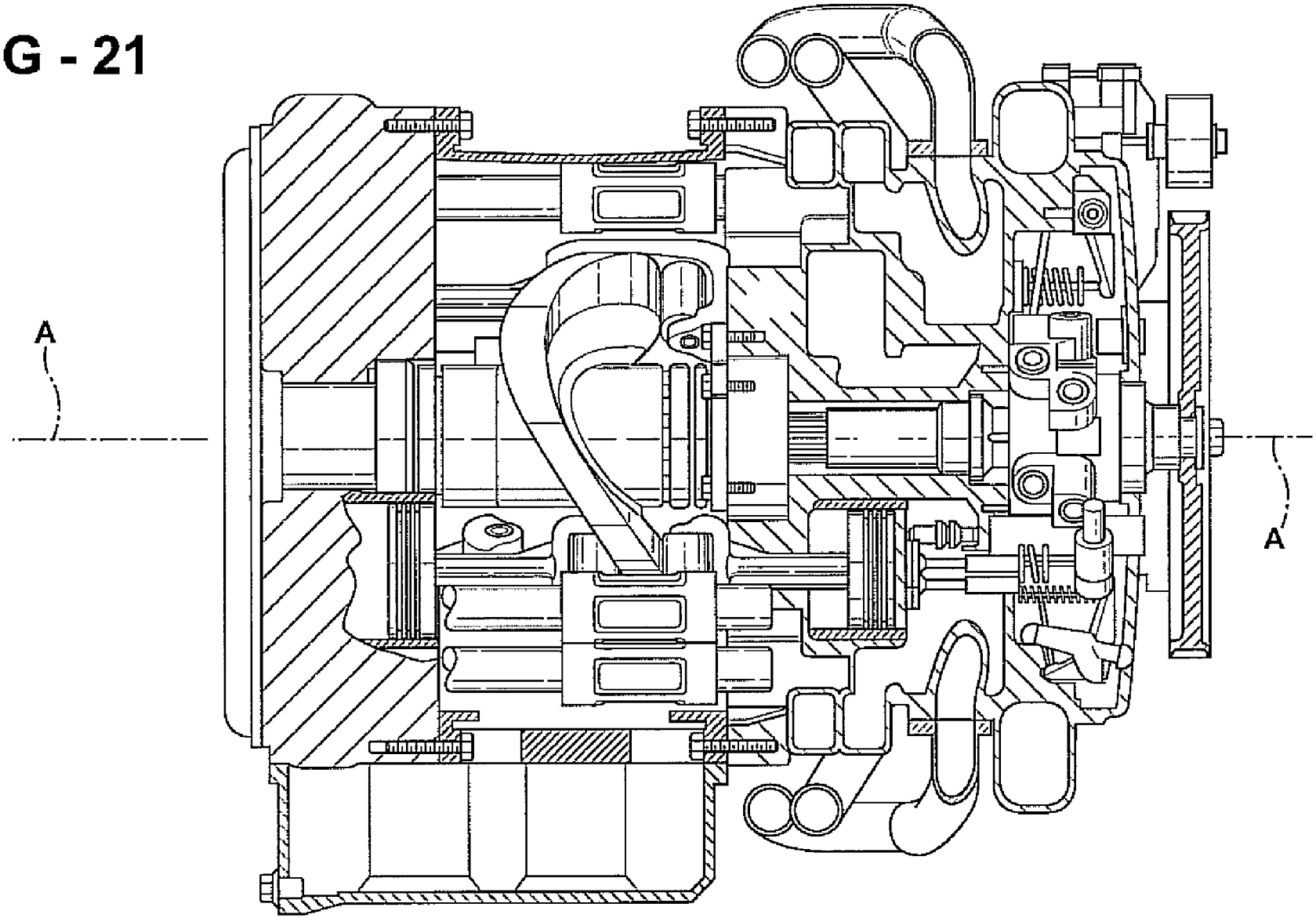
FIG. 21 is a cross sectional view of a barrel engine according to an alternative embodiment of the present invention.

As mentioned previously, an engine according to another embodiment of the present invention is a single ended engine, which lacks the compressor end. FIG. 21 illustrates such an embodiment, which is similar to the above-described embodiment except that the piston assemblies are single ended and an output cover or housing replaces the second monoblock.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

I claim:

1. A barrel internal combustion engine comprising:

a drive shaft assembly including a central drive shaft and a cam plate extending therefrom;

a one piece monoblock having a longitudinal central axis with a central longitudinal opening receiving the drive shaft, the one piece monoblock further defining:

a plurality of combustion chambers each having an axis parallel to the central axis, the combustion chambers being defined in a circle concentric with the longitudinal axis, each combustion chamber having a generally cylindrical side wall, a first closed end and a second open end, an intake valve opening and an exhaust valve opening being defined in the first closed end of each combustion chamber;

a coolant system including a plurality of coolant passages;

a plurality of intake passages each in fluid communication with one of the intake valve openings; and a plurality of exhaust passages each in fluid communication with one of the exhaust valve openings;

a plurality of piston assemblies each having a piston received in one of the combustion chambers, the piston assemblies being in mechanical communication with the cam plate of the drive shaft assembly; and a valvetrain including a plurality of intake valves and exhaust valves, each of the valves being received in one of the valve openings in the combustion chambers.

2. A barrel internal combustion engine according to claim 1, wherein the monoblock further defines an intake manifold in fluid communication with the plurality of intake passages.

3. A barrel internal combustion engine according to claim 2, wherein the intake manifold is generally annular and concentric with the axis of the monoblock.

4. A barrel internal combustion engine according to claim 3, wherein the generally annular and concentric coolant manifold is disposed entirely radially outboard of the combustion chambers.

5. A barrel internal combustion engine according to claim 1, wherein the coolant system defined by the monoblock further includes at least one coolant manifold, the coolant manifold being generally annular and concentric with the axis of the monoblock, the coolant manifold being in fluid communication with the coolant passages.

6. A barrel internal combustion engine according to claim 1, wherein the coolant system defined by the monoblock further includes a first and a second coolant manifold, the coolant manifolds each being generally annular and concentric with the axis of the monoblock, the coolant manifolds being in fluid communication with the coolant passages.

7. A barrel internal combustion engine according to claim 6, wherein each of the coolant manifolds defines a C-shaped passage extending between a pair of spaced apart ends.

8. A barrel internal combustion engine according to claim 7, wherein the C-shaped passages each taper downwardly between a port and the ends.

9. A barrel internal combustion engine according to claim 8, wherein the port in each of the C-shaped passages is generally midway between the ends, the port of the first manifold and the port of the second manifold being positioned generally on opposite sides of the engine such that the downwardly tapered ends of one manifold are disposed adjacent the port of the other manifold.

10. A barrel internal combustion engine according to claim 1, further comprising a drive case attached to the monoblock and a second monoblock attached to the drive case, the second monoblock defining a plurality of compression chambers, the piston assemblies each further included a second piston received in one of the compression chambers.

11. A barrel internal combustion engine according to claim 1, further comprising a drive case attached to the monoblock and an output housing attached to the drive case.

12. A barrel internal combustion engine according to claim 11, further comprising:

a plurality of bolts fixedly securing the monoblock to the drive case, the bolts being spaced apart radially outwardly from the center axis and disposed along an outer periphery of the drive case and monoblock.

13. A barrel internal combustion engine comprising:

a drive shaft assembly including a central drive shaft and a cam plate extending therefrom;

an engine block having a longitudinal central axis with a central longitudinal opening receiving the drive shaft, the block having a plurality of combustion chambers each having an axis parallel to the central axis, the combustion chambers being defined in a circle concentric with the longitudinal axis, the block further having a plurality of coolant passages defined therein;

a coolant system comprising at least one coolant manifold, the coolant manifold being generally annular and concentric with the axis of the block, the coolant manifold being in fluid communication with the coolant passages in the block; and a plurality of piston assemblies each having a piston received in one of the combustion chambers, the piston assemblies being in mechanical communication with the cam plate of the drive shaft assembly.

14. A barrel internal combustion engine according to claim 13, wherein the block comprises a one piece monoblock.

15. A barrel internal combustion engine according to claim 13, wherein the coolant system further includes a second coolant manifold, the second coolant manifold being generally annular and concentric with the axis of the block, the coolant manifold being in fluid communication with the coolant passages.

16. A barrel internal combustion engine according to claim 15, wherein each of the coolant manifolds defines a C-shaped passage extending between a pair of spaced apart ends.

17. A barrel internal combustion engine according to claim 16, wherein the C-shaped passages each taper downwardly between a port and the ends.

18. A barrel internal combustion engine according to claim 17, wherein the port in each of the C-shaped passages is generally midway between the ends, the port of the first manifold and the port of the second manifold being positioned generally on opposite sides of the engine such that the downwardly tapered ends of one manifold are disposed adjacent the port of the other manifold.

19. A barrel internal combustion engine according to claim 13, further comprising an intake manifold that is generally annular and concentric with the axis of the block.

20. A barrel internal combustion engine according to claim 13, wherein the generally annular and concentric coolant manifold is disposed entirely radially outboard of the combustion chambers.

21. A coolant system for a barrel internal combustion engine of the type having a central longitudinal axis and a plurality of combustion chambers defined in a circle concentric with the axis, the chambers each having an axis parallel to the longitudinal axis, the coolant system comprising:

a first and a second coolant manifold, each coolant manifold being generally annular and concentric with the axis of the engine, each manifold defining a C-shaped passage extending between spaced apart ends.

22. A coolant system according to claim 21 wherein the C-shaped passages each taper downwardly between a port and the ends.

23. A coolant system according to claim 22, wherein the port in each of the C-shaped passages is generally midway between the ends, the port of the first manifold and the port of the second manifold being positioned generally on opposite sides of the engine such that the downwardly tapered ends of one manifold are disposed adjacent the port of the other manifold.

* * * * *